US006022450A

United States Patent [19]

Van Kessel et al.

[11] Patent Number: 6,022,450

[45] Date of Patent: Feb. 8, 2000

[54] PAPER AND CARDBOARD COMPRISING STARCH- AND PROTEIN-CONTAINING MATERIAL

[75] Inventors: Louis Peter Marie Van Kessel, Kessel; Gerardus Henricus Andreas Kuypers, Roermond; Matheus Petrus Marie Maessen, Helden, all of Netherlands

[73] Assignee: Roermond Papier B.V., TA Roermond, Netherlands

[21] Appl. No.: 09/043,268

[22] PCT Filed: Sep. 16, 1996

[86] PCT No.: PCT/NL96/00362

§ 371 Date: May 7, 1998

§ 102(e) Date: May 7, 1998

[87] PCT Pub. No.: WO97/10385

PCT Pub. Date: Mar. 20, 1997

[30] Foreign Application Priority Data

Sep. 15, 1995 [NL] Netherlands ..... 1001218

[51] Int. Cl.[7] ..... D21H 11/00; D21F 11/00; C09D 4/00; C08L 1/00; C08L 89/00

[52] U.S. Cl. ..... 162/174; 162/175; 162/158; 162/129; 162/135; 162/142; 106/125.1; 106/135.1; 106/124.1

[58] Field of Search ..... 106/125.1, 135.1, 106/124.1, 208.1; 162/158, 174, 175, 129, 135, 142

[56] References Cited

U.S. PATENT DOCUMENTS

| | | | |
|---|---|---|---|
| 1,622,496 | 3/1927 | Davidson et al. | 428/478.4 |
| 1,755,744 | 4/1930 | Munktell . | |
| 2,466,172 | 4/1949 | Kesler | 106/125.1 |
| 2,559,901 | 7/1951 | Schied | 106/134.2 |
| 3,163,549 | 12/1964 | Vollink et al. | 106/125.1 |
| 3,166,466 | 1/1965 | Puydak | 162/135 |
| 3,211,564 | 10/1965 | Lauterbach | 106/208.1 |
| 3,859,108 | 1/1975 | Ware et al. | 106/125.1 |
| 4,940,514 | 7/1990 | Stange et al. | 162/168.2 |
| 5,011,741 | 4/1991 | Hoffman . | |

FOREIGN PATENT DOCUMENTS

| | | | |
|---|---|---|---|
| 0554659 | 8/1993 | Germany | 162/142 |
| 554659 | 9/1993 | Germany | 162/142 |

*Primary Examiner*—Peter Chin
*Assistant Examiner*—Dionne A. Walls
*Attorney, Agent, or Firm*—Hoffmann & Baron, LLP

[57] ABSTRACT

Paper and cardboard containing starch and protein fractions of flour having improved strength, stiffness and surface properties, wherein the starch and protein fractions are subjected to a degradation with ammonium persulfate, amylase, an acid, protease or a combination thereof before being introduced to the paper or cardboard. After the starch and protein fractions have been degraded, they can be added to the paper fiber matrix or used as a sizing or glue.

20 Claims, No Drawings

PAPER AND CARDBOARD COMPRISING STARCH- AND PROTEIN-CONTAINING MATERIAL

The invention resides in the field of paper and cardboard manufacturing. In particular, the invention relates to the use of a combination of starch- and protein-containing material in paper and cardboard. In fact, in this specification and the claims, the term 'paper' is meant to include cardboard as well.

Traditionally, starches are used on a large scale and in large volumes in the paper and cardboard industry. In the production of coated paper, which is substantially used as graphic paper in the fine-paper industry, it is used as, inter alia, binding agent in the coating. In general, this starch is a modified starch.

In addition, starch is used as admixture for improving the strength properties, and in particular the dry-strength properties, of the paper. For that purpose, starches conventionally used in the paper industry and anionic and cationic derivatives of these starches are used, for which reference can be made to, for instance, EP-A-0 545 228 and WO-A-94/05855.

In this connection, further reference can be made to Kirk-Othmer, Encyclopedia of Chemical Technology, Third Edition (1981), John Wiley & Sons, Volume 16, p. 803 ff, in particular pp. 814–819.

In the most current uses of starch as fiber-reinforcing component, it is either introduced—usually in the form of cationic starch—into the mass of the paper in the wet portion of the paper process, or impregnated—substantially in the form of solubilized native starch—into the paper fiber mass by means of the so-called size press.

These known strength-improving additives are advantageous, both in an economical and in a technical or technological sense; they give the paper or the cardboard an added value. Apart from providing an added value in conventional paper and cardboard processes, the need for additives for increasing the strength is enhanced in particular by the increasing use of weaker fibers, old paper that is reused more and more often, and a further increasing use of fillers instead of fibers in this old paper, resulting in a decreasing strength potential, and the decreasing availability of strong, long-fiber components in the base pulp for paper.

Actually, it is now emphasized that the invention is not limited to "waste-based" paper. The invention extends across the entire area of paper and cardboard manufacture, including paper based on "virgin fiber".

The known starch-based additives can enter into large-scale interactions with the cellulose groups of paper fibers. Thus, an increase of the number of bonds between the mutual paper fibers is formed, which reinforces the fiber-fiber bond and, accordingly, improves the strength properties of the final product.

In conventional processes wherein starches are used as strengthener, strict requirements are imposed on the protein content that may be present in the starch product used. In particular, native starch used for the manufacture of paper, substantially native wheat-, corn- or potato starch, is supplied with an additional specification for maximum protein contents of 0.3–0.5 wt. %, calculated on the dry substance. Higher protein contents are supposed to have a contaminating effect and to cause lump formation and depositions in the system. For instance, the dispersion of gluten (the protein fraction in wheat flour) leads to lumping and foam formation. These drawbacks occur to an enlarged extent when these proteins are exposed to higher temperatures in the paper manufacturing process.

The starch which forms the basic material for presently used starch additives in paper is recovered from a large number of vegetable sources, for instance from grains, such as wheat, corn and rice; from tubers, such as potatoes and tapioca; or from other plant parts, such as sago.

From the above-mentioned vegetable sources, the starch is released by the use of a combination of mechanical steps, purifying steps and drying steps. The separated protein-containing fractions, as well as other by-product fractions, are discharged. The starch purification involves the release of many waste flows, such as water flows containing biological material. These flows are increasingly becoming an environmental problem, so that draining without more is no longer possible.

The preparation of the starch that is used in the paper industry in the largest amounts as fiber-reinforcing and paper-stiffening agent, viz. wheat starch, is described as example. Similar processes are carried out for rendering starch from other vegetable sources applicable to the paper industry.

Wheat grains substantially consist of two components. The core, the so-called endosperm, largely consists of starch and protein. The outer layer, the brans or the chaff, mainly contains cellulose. The ratio core:outer layer is about 80:20.

These wheat grains are ground, the chaff being separated from the core. The separated endosperm, consisting for about 70–80% of starch and for about 10–15% of protein, is commonly designated by the term "flour". Depending on the extraction degree of the wheat, more or less pure flour is obtained. For instance, at an extraction degree of about 80%, "grey flour" is obtained, while at a somewhat lower extraction degree of about 70%, considerably purer flour is obtained, because at this extraction degree, no parts other than the endosperm end up in the flour.

In the production of starch for the paper industry, the protein, in particular the gluten, is subsequently washed from the flour. The flour is thus separated into two main components. As indicated, in this process, economically unprofitable drying steps are carried out, a part of the starting substance wheat cannot be used, and waste flows are created that have to be processed.

The primary object of the present invention is to provide a method wherein an optimized use is made of raw materials in the sense that a largest possible fraction of the raw material can be used in the paper process.

This object is realized by introducing the components of flour into the manufacturing process of paper or cardboard completely, without this flour or flour components being priorly modified by binding cationic or anionic groups thereto or without such protein/starch mixtures being priorly dry-modified. In other words, the object is realized by starting from native protein/starch mixtures and using them as such. In this specification and claims, by "flour" is meant a protein- and starch-containing fraction originating from one and the same vegetable source, or a natural mixture of protein and starch.

More in particular, the invention relates to paper or cardboard comprising the components of native flour in the paper fiber matrix. In addition, the invention relates to a method for manufacturing paper or cardboard wherein flour is substantially subjected to a treatment whereby starch and protein are solubilized, after which the treated components of flour are jointly introduced into the paper fiber matrix in one step. Moreover, the invention relates to a method wherein vegetable starch sources can be used entirely, hence without generating waste products, in the paper industry.

Accordingly, the invention relates to paper of cardboard comprising protein and starch, at least partly originating from the same source, in the paper fiber matrix. Further, the invention relates to paper or cardboard into which all components from vegetable starch/protein sources have been processed.

It has been found that by the use of an amount of flour according to the invention, paper can be obtained which has substantially the same properties as paper wherein about the same amount of starch is used. In other words, the function of a part of the conventionally required starch can be taken over by the protein fraction in flour, although the prior art merely teaches disadvantageous properties. In addition to economical advantages—flour is cheaper than starch prepared therefrom—, technological and environmental advantages are obtained as well, because no drying steps or purifying steps have to be carried out, and/or because no waste flows have to be discharged.

The paper according to the invention preferably comprises at least 0.1 wt. %, more preferably at least 0.3 wt. %, and usually 0.3–8 wt. % starch and at least 0.03 wt. %, preferably between 0.05 wt. % and 2.4 wt. %, usually 0.05–1 wt. % protein in the paper fiber matrix, calculcated on the weight of the dry substance. If less than the minimum contents of protein and starch are used, the advantages obtained according to the present invention are too slight or other conventional auxiliary substances are required for obtaining the desired paper properties. It is true that if more than 8 wt. % starch and more than 1 wt. % protein is used, paper of a very high added value is obtained, but from a business-economical viewpoint, the process is often less attractive.

Preferably, 2–5 wt. % starch in addition to 0.2–1 wt. % protein is introduced into the paper fiber matrix, because this combines the advantages of the invention with a favorable production price.

In accordance with the present invention, the protein and starch fraction at least partly originates from one and the same vegetable source. As vegetable sources that can be used for this purpose, those having a high content of starch next to protein can be mentioned, for instance seeds, such as beans, peas and grains, for instance wheat, corn and rice grains; and other protein- and high starch-containing plant parts. In the present specification and claims, these products are designated by the term "flour".

Preferably, flour originating from grains or pulses, preferably wheat flour, is introduced into the fiber mass of the paper or cardboard. A great advantage of the use of flour originating from grains and pulses is that from an economical viewpoint, for use in accordance with the present invention, this raw material is more attractive than the starch that is normally used. For instance, at this moment, the cost of wheat flour are about half the cost of native wheat starch.

Further, because of the omission of the separation of flour into a starch and protein component, the energy consumption is reduced considerably, partly because no drying steps have to be carried out.

Flour originating from grains or pulses, and in particular wheat flour, is used in amounts of preferably 2–5% calculated on the dry mass.

Wheat flour cannot be introduced into the paper as such. If this is attempted, the drawbacks known from the prior art—high degree of deposition, lumping, dough formation, foam formation—occur. The problems prove not to occur when the flour is at least subjected to a treatment known for native starch in the paper industry.

As a skilled person knows, for use on the size press, a product dissolved in water and having a Brookfield viscosity of less than about 100 cP is required. Such a solution (it is suitable to start from a 10 wt. % flour suspension) can be obtained by treating wheat flour with a chemical and/or enzymatic starch chain-degrading agent to obtain a viscosity in the above-mentioned range. For instance, flour can be subjected to a degradation with ammonium persulfate (APS), known for native starch, optionally in the presence of an acid, for instance acetic acid or citric acid. The presence of acid in this embodiment is for instance needed if wheat flour is started from, which is illustrated in Example 2. Other methods are treatments with amylases or combinations thereof with APS, optionally complemented with a protein-modifying step.

Whereas for an interference-free size press treatment, the viscosity of native starch solutions known from the prior art is preferably between about 30 and 80 cP, a viscosity as low as only 15 cP is sufficient when flour is used. From Example 1 below, it appears that this produces a paper of the same quality as in the case where only starch is used.

In fact, it is also possible to eliminate interfering properties caused by the protein component in flour by substantially degrading this protein component and, accordingly, only utilizing the starch component effectively.

However, this embodiment lacks a number of the advantages of the present invention.

Dutch patent application 1001218 describes that proteins can improve the strength properties of paper and cardboard and, in addition, have a large number of advantages when they are present in the paper fiber matrix. In particular, proteins inter alia provide, apart from improved stiffness values, SCT—("Shortspan Compression Test"), RCT—("Ring Crush Test"), and CMT—("Concora Medium Test") values—and strength values—inter alia burst pressure, tensile strength—, which values are a measure for specific strength properties of the paper, in particular for the production of corrugated board, optimization possibilities and improvements in other constructional paper properties, such as stiffness, in properties of processability, such as foldability and scoring facility, and in functional properties, such as permeability to gases and liquids. Moreover, the use of proteins in paper manufacturing provides optimization possibilities and improvements in the field of general process control, usability of raw and auxiliary materials, and energy demand. Further, the above-mentioned properties can be controlled depending on the manufacturing conditions and conditions of application, for instance climatological conditions, without this being at the expense of the reprocessability of the paper product and the output of the production process.

In accordance with the present invention, it has now been found that the advantages mentioned in Dutch patent application 1001218 can also be obtained by the use of flour components in paper. For that purpose, not only the one-step treatment as known for native starch should be carried out, but a second treatment should be carried out as well. For the use of wheat flour with the size press, this second treatment is a deamidation reaction and/or a partial proteolysis. This second treatment renders the wheat gluten more water-soluble and can be carried out in a thermo-chemical manner (warming by acid) as well as in an enzymatic manner (protease).

In a preferred embodiment, the wheat flour is treated with acid APS at a temperature of about 85–95° C. In addition to the degradation of the starch, this treatment provides at the same time a processing of the protein.

As appears from the examples given below, synergistic effects occur when a starch/protein mixture prepared in an unseparated manner is used in conformity with the invention. The effect of flour on the strength and stiffness properties of paper is as great as and sometimes even greater than the effect of an approximately equally large weight fraction of conventionally treated and used, native starch.

It has been demonstrated that by introducing protein and starch molecules into the paper fiber matrix, in particular the stiffness and strength properties can be positively modified and controllably influenced.

These paper properties are not only important in respect of wrapping papers based on recirculated material, but also in respect of solid cardboard and various types of paper based on "virgin fiber".

For obtaining a good paper product, it is essential that the protein and/or starch molecules be present in the paper sheet. After all, the optimization of the fiber-fiber bond of the paper, whereby the resulting advantages can—probably—be explained, can only take place when sufficient protein and/or starch material is present on, in and between the fibers. In this manner, the paper fiber mass and the protein and starch fraction form a whole; no clearly sharply delimited protein and starch masses and paper fiber masses are distinguished.

The advantageous effects of the use of protein in combination with starch in the bulk of the paper are dependent, sometimes even to a high degree, on the place or manner of applying and/or the nature of the protein introduced. After taking cognizance of the specification of the present invention, it will be within the scope of a skilled person to adjust the paper-manufacturing process, including the raw and auxiliary materials to be used, depending on the wishes of the customer/user and the conditions.

These above-mentioned flour-processing methods generally and mainly bring the protein fraction into solution, while the starch is solubilized and degraded. The treatment of the flour can be carried out batchwise as well as continuously-in-line.

The invention further relates to a method for manufacturing paper or cardboard, comprising at least a step wherein proteins and starch, i.e. the product as it is recovered from a natural product as unseparated vegetable protein/starch mixture, optionally after being subjected to the above-elaborated treatment analogously with the treatment carried out with native starch, is introduced into the paper fiber matrix.

In conventional paper-manufacturing processes the first treatment consists in so-called pulping—preparing pulp by suspending fiber materials in paper that may or may not have been circulated. In a large vat, by the use of mechanical energy, usually by stirring, and heating, usually with steam or warm water, fiber material is added to water. Through the mechanical and physical treatment, the fiber material is dissolved or dispersed to create a liquid mash, the pulp. Next, the pulp is subjected to a number of treatments. For instance, the pulp is cleaned, with unusable, nonfibrous material being removed from the pulp. Moreover, if necessary, a fiber treatment, such a grinding, is carried out. Finally, the pulp is presented in a specific concentration to the paper machine which manufactures paper from the pulp.

In accordance with the invention, during the method for manufacturing paper, at least a step is carried out whereby proteins and starch are jointly introduced into the paper fiber matrix.

During the process pass from pulp vat to paper machine, auxiliary substances, including the protein-starch mixture used according to the present invention, preferably wheat flour, can be added. Moreover, after sheet formation, the protein and starch material can be provided thereon and then—by performing specific treatments—introduced into the fiber matrix.

For instance, during the paper sheet formation, protein-starch solutions can be introduced into the paper layer or between different paper layers, if any, for instance through spraying or foaming. Also, the protein-starch material can be introduced into the fiber mass by means of a surface treatment or impregnation of the paper already formed, for instance and preferably by means of a size press treatment. Finally, reference is made to the possibility of applying protein material to the dry paper web through spraying or other known application techniques.

In a preferred embodiment of the method according to the invention, protein-starch mixtures are introduced into the paper by means of a size press treatment. During the size press treatment—a treatment which is generally used in the paper industry and is therefore known to a skilled person—a solution or suspension containing the protein-starch mixture to be used is pressed into the paper by means of rolling. The size press treatment can be carried out single-sidedly on the top or bottom side of the paper web, as well as double-sidedly.

In particular for use in the size press, higher protein and starch concentrations have advantages with regard to the maximally feasible properties and reduced drying energy thus required.

In the above-mentioned techniques, it is always important that at least a part of the proteins and the starch be brought into close contact with the fibers in the paper fiber matrix.

Further, it is possible to introduce, in addition to the joint introduction of a protein/starch mixture, supplementary amounts of starch or protein. This can take place at the same place by the use of the same technique, but also at other places in the paper-preparing process.

The invention relates to the use of flour components in the fiber matrix of paper for improving and directing paper properties such as strength, stiffness, permeability, surface properties and elasticity. Moreover, the flour fraction treated according to the invention can be used as glue for fixing the corrugations in corrugated cardboard.

The invention also relates to the use of protein- and starch-containing materials wherein, for attaining the desired paper properties, only the starch fraction is modified chemically or enzymatically. If the starting material contains, in addition to starch, for instance water-soluble proteins, it is not necessary to modify these proteins in order to produce a size having good processing and reinforcing properties. An example hereof is pea meal of which the proteins are soluble in an alkaline medium.

Moreover, for reinforcing the paper, it is possible to use only the starch fraction of starch- and protein-containing materials. On the one hand, this can be effected on account of the fact that the protein, without modification, is water-soluble so that it is either pressed through the paper during the paper treatment, or, present in the paper matrix, does not contribute to the paper properties. On the other hand, the protein can be modified too far, as a consequence of which it does not contribute to the paper properties either. In the most extreme case, the protein is degraded into amino acids. An advantage hereof is that no sharply delimited processing degree of the protein has to be set, so that the conversion of starch- and protein-containing material into the suitable size is not a very critical process.

Finally, the invention relates to a method for manufacturing paper wherein vegetable material having as main components protein and starch, preferably grain, is completely processed, comprising separating the vegetable material into (a) a fraction substantially consisting of the cellulose material and (b) a fraction substantially consisting of the protein and starch material, feeding fraction (a) to the usual starting paper fiber mass, for instance during the preparation of pulp, and feeding fraction (b) in the step wherein fiber-reinforcing additives are introduced. The fraction fed in the step wherein fiber-reinforced additives are introduced is treated in conformity with the above-described method. In particular, in this aspect of the invention it is possible to completely grind up a vegetable protein and starch source, for instance wheat, and to use the ground-up product directly—after a modification that is analogous with native starch and optionally after a modification wherein the protein properties are optimized—as fiber-reinforcing, quality-improving component, and to use the residual products, such as the chaff, directly as fiber material. The modification of the flour can consist of a thermochemical conversion, for instance with APS and/or acid, for instance citric acid, optionally in combination with an enzymatic modification with, for instance, amylase and/or protease.

Presently, the invention will be specified with reference to the following examples.

EXAMPLE 1

In this example, the effect of the use of flour (IJsvogel-flour, Meneba Nederland; moisture content 13.5%; about 10 wt. % gluten and about 89.5 wt. % starch calculated on the dry product) was studied. For that purpose, suspensions of flour and—for comparison—native starch were introduced into paper by means of the size press method.

The solutions of the above-mentioned macromolecules were set at a desired viscosity by subjecting both the starch fraction and the flour fraction to a degradation with ammonium persulfate (95° C.). For an interference-free size press application, the viscosity of the starch suspension should be between 30 and 80 cP; good results with the flour suspension are already obtained at a viscosity of only 15 cP.

The macromolecules-containing solutions were introduced into paper (recycled paper; D-Liner; Roermond Papier) by means of a laboratory size press (Einlehner, rate 30 m/min, temperature 70° C., pressure 2 bar).

The SCT-value and the burst factor were determined according to standardized requirements.

The SCT-value is the maximum compression force per width unit that a test strip can undergo under defined conditions until this strip becomes upset. In this example, the SCT-determination was carried out perpendicularly to the machine direction of the paper. The SCT-value is expressed in kN/m.

The burst factor is determined from a burst pressure measurement. The burst pressure is the pressure exerted on a piece of paper at the moment when the paper cracks. The burst factor (expressed in kPa) is equal to the burst pressure multiplied by 100 divided by the basic weight ($g/m^2$).

The results are stated in the following table.

TABLE 1

| | Increase of the SCT-value and the burst factor relative to the control during the use of flour or starch | |
|---|---|---|
| | SCT-value (kN/m) | burst factor (kPa) |
| starch | 0.75 | 48 |
| flour | 0.65 | 42 |

It has been found that the use of flour gives almost the same increase in SCT-value and burst factor as starch. Moreover, a further influencing of the strength properties can be obtained by using a flour suspension having a different viscosity.

EXAMPLE 2

Pretreatments of Flour Slurries

A) Treatment with Neutral APS

A suspension of 694 g IJsvogel-flour in 1306 g water (50° C.) was stirred in a beaker. 2.16 g APS was added, followed by stirring for another 30 minutes at 50° C. The resulting solution was diluted to a 10 wt. % solution. Heating at 75° C. took place for 30 minutes, after which the whole was boiled for another 60 minutes in a water bath.

B) Treatment with Acid APS

A suspension of 232 g IJsvogel-flour in 1309 g water was stirred in a beaker. Citric acid was added to a pH of 4, after which 0.72 g APS was fed. After that, the mixture was allowed to boil for 60 minutes in a water bath.

C) Treatment with APS and Protease

A suspension of 694 g IJsvogel-flour in 1306 g water (50° C.) was stirred in a beaker. 1000 $\mu$l Neutrase (NovoNordisk) was added, followed by stirring for another 30 minutes at 50° C. The resulting solution was diluted into a 10 wt. % solution. 2.16 g APS was added. The whole was boiled for 60 minutes in a water bath.

D) Treatment with Amylase and Protease

A suspension of 694 g IJsvogel-flour in 1306 g water (50° C.) was stirred in a beaker. 933 $\mu$l Ban $\alpha$-amylase and 1000 $\mu$l Neutrase (both NovoNordisk) were added, followed by stirring for another 30 minutes at 50° C. The resulting solution was diluted to a 10 wt. % solution. For 30 minutes the temperature was increased to 75° C. After that, the whole was boiled in a water bath for another 30 minutes.

Of the four slurries A–D treated, the Brookfield viscosity was determined in cP. The measuring results are shown in the following table.

TABLE 2

| | | | Brookfield viscosity (cP) |
|---|---|---|---|
| A | APS | — | 700 |
| B | APS | citric acid | 40 |
| C | APS | protease | 40 |
| D | $\alpha$-amylase | protease | 25 |

The flour solutions having viscosities lower than 100 cP could readily be processed on the size press.

EXAMPLE 3

With a flour slurry obtained according to method D in Example 2 and a 10 wt. % standard starch slurry, test sheets (Testliner 3 Roermond Papier, 160×100 mm) were treated on a laboratory size press (Einlewner, rate 30 m/min, temperature 70° C., pressure 2 bar). The impregnated sheets were dried on a drying cylinder at 130° C.

Of these test sheets, the paper properties were determined under conditioned circumstances (23° C., 50% RV) according to standardized methods. The measuring data are stated in the following table.

TABLE 3

Strength and stiffness properties

| paper property | starch (standard) | flour (enzymatic) | activity rel. to 100% starch |
|---|---|---|---|
| take-up (%) | 3.2 | 3.2 | |
| burst factor (kPa) | 241 | 273 | +13% |
| breaking length (m) | 6454 | 6915 | +7% |
| stretch (%) | 1.93 | 2.13 | +10% |
| SCT (140 g) (kN/m) | 2.46 | 2.76 | +12% |
| stiffness (kNm) | 1022 | 1036 | +1% |
| CMT 30 (140 g) N | 278 | 284 | +2% |

In this table, "take-up" is the weight percentage flour/starch relative to the dry paper.

EXAMPLE 4

Use of Pea Meal

The proteins in pea meal are water-soluble. From pea meal, a flour size is made by modifying only the starch. In a number of experiments, the starch in pea meal is degraded by means of APS or enzymes.

TABLE 4

| treatment | size viscosity (cP) | SCT-value (kN/m) |
|---|---|---|
| APS | 150 | riot determined |
| APS + citric acid | 30 | 4.2 |
| BAN | 80 | 4.2 |
| Termamyl | 60 | 4.4 |

If a suspension of pea meal is only treated with APS, the suspension obtains a high viscosity, as a consequence of which the size is difficult to apply to paper. By reducing the pH of the suspension with citric acid, the APS becomes more effective, so that a size is obtained that does meet the Theological requirements. When this size is applied to paper, the SCT-value is increased. Also the enzyme BAN and Termamyl degrade the starch sufficiently in a suspension of pea meal to obtain a viscosity lower than 100 cP. During application to paper, the SCT-value is increased.

EXAMPLE 5

Test on Production Scale

In a test reactor, a four slurry with enzymes (Neutrase) was suspended. Next, this slurry was thermochemically gelatinized with ammonium persulfate over a jet-cooker (NEMO-converter). On the paper machine 1 (PM1) of Roermond Papier, the flour slurry was processed on the size press.

In particular, a practical production run of the quality Testliner 3 (RP-Maasliner) in 140 g was carried out.

Machine conditions: standard, i.e.:

composition of raw material according to formulation (recycled material);

2-layer embodiment;

in-line treatment on size press;

weight increase though size press treatment: about 3%;

rate PM: 625 m/min;

final moisture content paper: 7%.

During this paper production, the size press solution of native wheat starch (thermochemical conversion with ammonium persulfate (APS)) was replaced during the run by flour (IJsvogel; conversion: starch thermochemically with APS and protein part enzymatically by means of Neutrase).

Processing: good. Result comparable with 100% starch.

Paper properties: the paper properties are equal to/comparable with starch.

Depositions and foam formation resulting from gluten were not observed in the system.

TABLE 5

Practical test Maasliner (T.L.3), RP-PM1

| Paper properties | | | Starch (standard) | Flour |
|---|---|---|---|---|
| Gram weight | | $g/m^2$ | 140.1 | 139.9 |
| Final moist. cont. | | % | 7.1 | 7.0 |
| Take-up (size press) | | % | 3.2 | 3.1 |
| Burst pressure | | kPa | 340 | 335 |
| Burst factor | | kPa | 243 | 239 |
| Breaking 1. | m.d. | m | 6,610 | 6,640 |
| Stretch | m.d. | % | 1.90 | 1.90 |
| R.C.T. | t.d. | kN/m | 1.23 | 1.18 |
| S.C.T. | m.d. | kN/m | 4.53 | 4.65 |
| S.C.T. | t.d. | kN/m | 2.30 | 2.49 |
| Stiffness | m.d. | kN/m | 960 | 940 |

TABLE 6 properties stated

| | Paper property | Unit | Standard |
|---|---|---|---|
| 1. | Gram weight | $g/m^2$ | ISO 536 |
| 2. | Moisture content | % | ISO 287 |
| 3. | Burst pressure | kPa | ISO 2758 |
| 4. | Burst factor $\left(= \frac{\text{burst pr.} \times 100}{g/m^2}\right)$ | kPa | ISO 2758 |
| 10. | S.C.T. | kN/m | DIN 54518 |
| 11. | R.C.T. | kN/m | DIN 53134 |
| 12. | C.M.T.-30 | N | ISO 7263 |
| 13. | Porosity (acc. to Bendtsen) | ml/min | ISO 5636/3 |
| 8. | Stiffness | kN/m | ISO 1924/2 |
| 5. | Tensile strength | kN/m | ISO 1924/2 |
| 9. | Tearing strength | mN | ISO 1974 |
| 14. | Ply-bond (Scott-Bond) | $J/m^2$ | Tappi UM 403 |
| 7. | Stretch | % | ISO 1924/2 |
| 6. | Breaking length | km | ISO 1924/2 |

Note:
the determinations according to 5, 6, 7, 8, 9, 10, 11 and 12 can be performed in the fiber direction of the paper = machine direction (m.d.) or longitudinal direction (l.d.), or in the transverse direction (t.d.).

EXAMPLE 6

Example 5 was repeated, the flour slurry with citric acid being suspended. The results were comparable with those in Example 5.

We claim:

1. Paper or cardboard comprising protein and starch components of flour in the paper fiber matrix, wherein the components are subjected to a degradation with ammonium persulfate (APS) and protease, APS and amylase, APS and an acid, or amylase and protease, in order to solubilize the protein and starch components of the flour, before being introduced to the paper or cardboard.

2. The paper or cardboard according to claim 1, wherein the starch component is 0.1–8 wt. % and the protein component is 0.3–1.4 wt. %, calculated on the weight of the dry paper fiber matrix.

3. The paper or cardboard according to claim 1, wherein the starch component is 2–5 wt. % and the protein component is 0.2–1 wt. %, calculated on the weight of the dry paper fiber matrix.

4. The paper or cardboard according to claim 1, 2 or 3, wherein the components originate from agricultural products.

5. The paper or cardboard according to claim 1, wherein acid is added to the components to effect deamidation of the protein component before the components are subjected to degradation with ammonium persulfate.

6. The paper and cardboard according to claim 1, wherein the components are subjected to degradation with protease, ammonium persulfate, and an acid.

7. The paper or cardboard according to claim 1, wherein the components are subjected to degradation with protease and amylase and then heated.

8. The paper or cardboard according to claim 1, wherein the degradation reduces the viscosity to less than about 100 centipoise.

9. The method for manufacturing paper or cardboard according to claim 1, wherein the degraded flour is introduced into the paper by a size press method.

10. A method for manufacturing paper or cardboard from a fiber matrix and flour comprising subjecting at least the flour to a deamidation reaction and/or partial proteolysis treatment comprising, mixing the flour with ammonium persulfate (APS) and protease, APS and amylase, APS and an acid, or amylase and protease, in order to solubilize the protein and starch components of the flour, and introducing the treated flour into the fiber matrix in one step.

11. The method according to claim 10, wherein the flour is introduced into the paper fiber matrix utilizing a size press.

12. The method according to claim 11, wherein the flour has a protein fraction and the protein fraction is rendered water-soluble.

13. The method for manufacturing paper or cardboard according to claim 10, wherein acid is added to the flour to form an acidic mixture and ammonium persulfate is added to the mixture.

14. The method for manufacturing paper or cardboard according to claim 10, wherein protease is added to the flour to form a mixture and ammonium persulfate is added to the mixture.

15. The method for manufacturing paper of cardboard according to claim 10, wherein protease and amylase are added to the flour and then heated.

16. The method for manufacturing paper or cardboard according to claim 10, wherein said treatment further comprises heating the treated flour prior to introducing it to the fiber matrix.

17. The method for manufacturing paper or cardboard according to claim 10, wherein said acid is citric acid or acetic acid.

18. A method for manufacturing paper from a starting paper fiber mass, wherein vegetable material of a high protein and starch content is processed completely, comprising separating the vegetable material into (a) a fraction substantially consisting of the cellulose material and (b) a fraction substantially consisting of the protein and starch material, feeding fraction (a) into the starting paper fiber mass to form a mixed paper fiber mass, treating fraction (b) with ammonium persulfate (APS) and protease, APS and amylase, APS and an acid, or amylase and protease, in order to solubilize the protein and starch components of the flour, and introducing the treated fraction (b) into the mixed paper fiber mass in one step.

19. Paper or cardboard having improved strength properties, stiffness properties, permeability, surface properties and elasticity comprising:

a paper fiber matrix; and vegetable material having as main components protein and starch;

wherein said protein and starch are degraded with ammonium persulfate (APS) and a proteolytic enzyme, APS and protease, APS and amylase, APS and an acid, or amylase and protease, in order to solubilize the protein and starch components of the flour, before being introduced into the paper fiber matrix.

20. A glue for forming the corrugation in corrugated cardboard, said glue comprising:

vegetable material having as main components protein and starch;

wherein said protein and starch are degraded with ammonium persulfate (APS) and a proteolytic enzyme, APS and protease, APS and amylase, APS and an acid, or amylase and protease, in order to solubilize the protein and starch components of the flour.

* * * * *